US006619349B2

(12) United States Patent
Gribovsky

(10) Patent No.: US 6,619,349 B2
(45) Date of Patent: Sep. 16, 2003

(54) BILLFOLD

(75) Inventor: Vladimir Gribovsky, 6301 Bay Ridge Rd., Mound, MN (US) 55364

(73) Assignee: Vladimir Gribovsky, Mound, MN (US)

( * ) Notice: Subject to any disclaimer, the term of this patent is extended or adjusted under 35 U.S.C. 154(b) by 0 days.

(21) Appl. No.: 09/907,465

(22) Filed: Jul. 17, 2001

(65) Prior Publication Data

US 2002/0053378 A1 May 9, 2002

Related U.S. Application Data

(60) Provisional application No. 60/218,633, filed on Jul. 17, 2000.

(51) Int. Cl.[7] ..... A45C 1/06; A45C 11/18

(52) U.S. Cl. ..... 150/135; 150/147

(58) Field of Search ..... 150/131, 132, 150/135, 140, 147; 206/38

(56) References Cited

U.S. PATENT DOCUMENTS 1,471,484 A * 10/1923 Humphreys ..... 150/140

D74,481 S 2/1928 Cowen (List continued on next page.)

FOREIGN PATENT DOCUMENTS

| | | | |
|---|---|---|---|
| DE | 0472005 | 2/1929 | |
| FR | 1249471 | 11/1960 | |
| GB | 18026 | * 10/1916 | ..... 150/140 |
| GB | 196814 | 4/1922 | |

*Primary Examiner*—Sue A. Weaver
(74) *Attorney, Agent, or Firm*—Patterson, Thuente, Skaar, & Christensen, P.A.

(57) ABSTRACT

A billfold having a front panel and a back panel that intersects the front panel along an edge. At least one of the front panel and the back panel have a first pocket formed therein. The first pocket has a width that permits currency to be placed therein in an unfolded orientation. The first pocket has a first retaining strap attached thereto that is sized to receive a portion of a checkbook to substantially prevent the checkbook from moving laterally in the first pocket.

20 Claims, 12 Drawing Sheets

U.S. PATENT DOCUMENTS

| | | | | | |
|---|---|---|---|---|---|
| 1,669,064 | A | * | 5/1928 | Minetti | 150/147 X |
| 1,683,996 | A | | 9/1928 | Snow | |
| D91,647 | S | * | 3/1934 | Buxton | 150/132 X |
| 1,995,518 | A | | 3/1935 | Perry | 150/147 |
| 2,183,428 | A | * | 12/1939 | McNary | 150/113 X |
| 2,397,366 | A | * | 3/1946 | Ogden | 150/140 |
| 2,419,092 | A | | 4/1947 | Schupbach | |
| 2,437,120 | A | * | 3/1948 | Parker | 206/38 X |
| 2,455,515 | A | | 12/1948 | Miller | |
| 2,473,056 | A | * | 6/1949 | Henderson | 15/140 |
| D157,738 | S | | 3/1950 | Chase | 150/136 |
| D160,147 | S | | 9/1950 | Chase | 150/132 |
| D161,264 | S | | 12/1950 | Jeffery | 150/136 |
| 2,613,718 | A | | 10/1952 | Vaughn et al. | |
| 2,667,199 | A | | 1/1954 | Knee | |
| 2,686,545 | A | | 8/1954 | Fontana | 150/137 |
| 2,719,557 | A | | 10/1955 | Bell | |
| 2,737,220 | A | * | 3/1956 | Hoff | 150/135 |
| 2,779,461 | A | | 1/1957 | Schweitzer | |
| 2,785,722 | A | | 3/1957 | Anderson | 150/137 |
| D181,550 | S | | 11/1957 | Rubeck | |
| 2,816,590 | A | | 12/1957 | Boots | 150/137 |
| D185,346 | S | | 6/1959 | Chase | |
| 2,955,633 | A | * | 10/1960 | Seitz | 150/132 |
| 3,058,506 | A | | 10/1962 | Parisi | |
| 3,199,562 | A | | 8/1965 | Seitz | 150/143 |
| 3,267,980 | A | * | 8/1966 | Bird | 150/135 |
| 3,299,929 | A | | 1/1967 | Shagin et al. | 150/147 |
| 3,446,260 | A | | 5/1969 | Osher | 150/147 |
| 3,454,069 | A | | 7/1969 | Machler | 150/137 |
| 3,753,519 | A | | 8/1973 | Gammon | |
| 3,799,331 | A | | 3/1974 | White | |
| 3,861,718 | A | * | 1/1975 | Strus | 281/17 |
| D239,572 | S | | 4/1976 | Leopoldi | |
| 4,075,702 | A | * | 2/1978 | Davies | 150/135 X |
| 4,221,251 | A | | 9/1980 | Wagner | 150/38 |
| D270,747 | S | | 9/1983 | Eisinger et al. | |
| 4,671,332 | A | | 6/1987 | McPhee | 150/132 |
| 4,741,372 | A | | 5/1988 | Santilli | |
| 4,751,664 | A | * | 6/1988 | Holm | 364/705 |
| 4,794,711 | A | * | 1/1989 | Christensen | 40/122 |
| 4,851,610 | A | | 7/1989 | LeBlanc et al. | 150/147 X |
| 4,907,634 | A | * | 3/1990 | Yoo | 150/147 X |
| 4,945,961 | A | | 8/1990 | Healy | |
| 4,966,210 | A | | 10/1990 | Folkerstsma | 150/138 |
| 5,199,573 | A | | 4/1993 | Gribovsky | |
| 5,222,764 | A | * | 6/1993 | Dyer | 150/147 X |
| 5,230,627 | A | * | 7/1993 | Todd | 150/135 X |
| 5,263,523 | A | | 11/1993 | Scheunemann | 150/132 |
| D345,859 | S | | 4/1994 | Gribovsky | |
| 5,653,276 | A | | 8/1997 | Niernberger | 150/137 |
| 6,026,873 | A | | 2/2000 | Van Geer | 150/147 |
| D422,406 | S | | 4/2000 | Dweck et al. | D3/247 |

* cited by examiner

Fig. 6
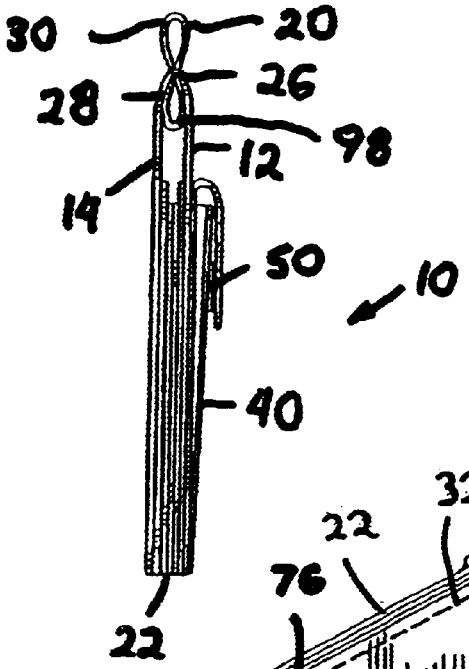
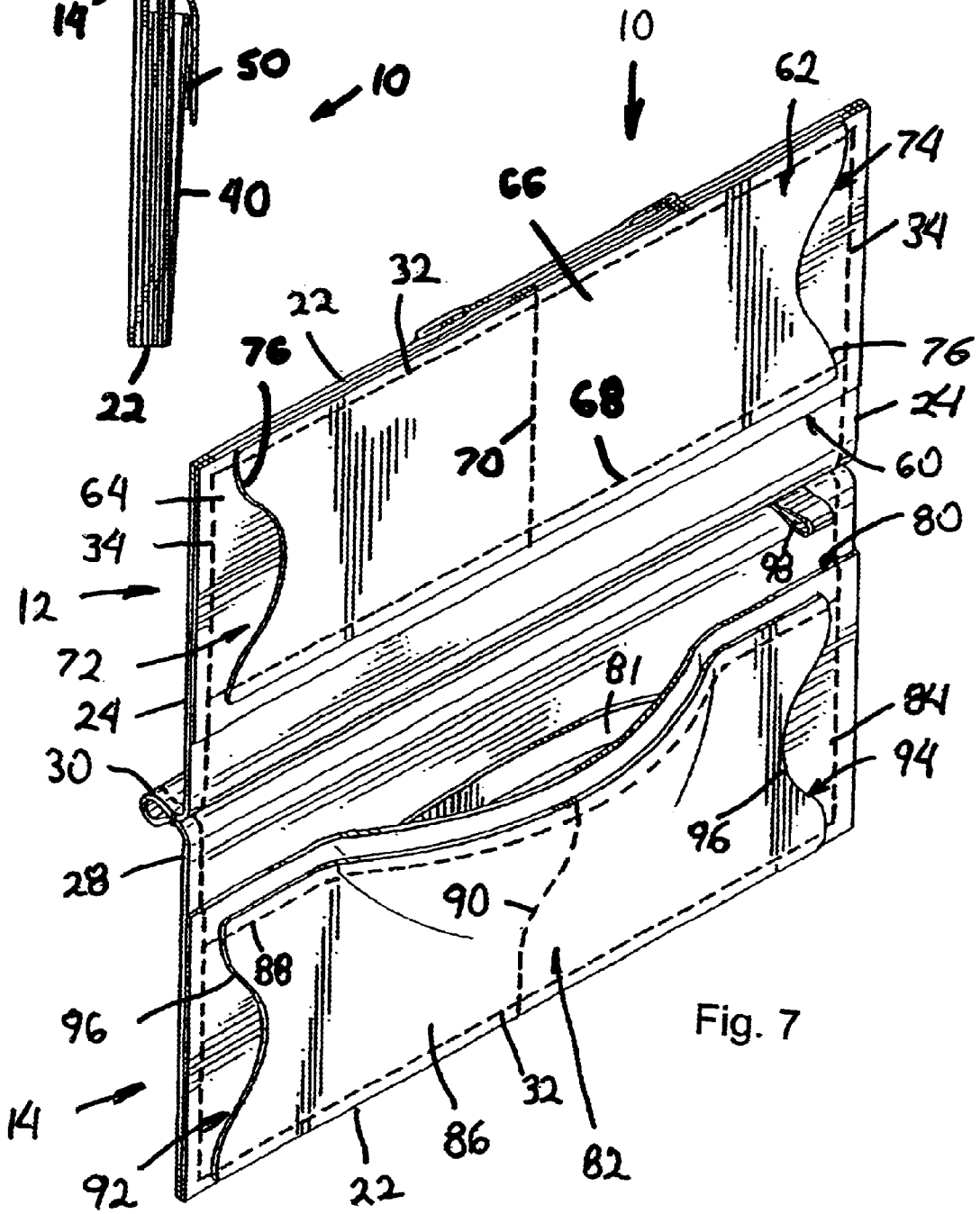
Fig. 7

Fig. 12
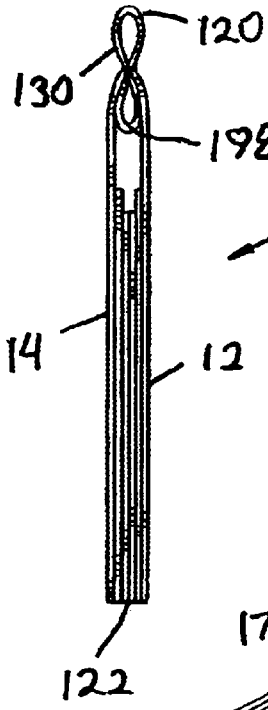
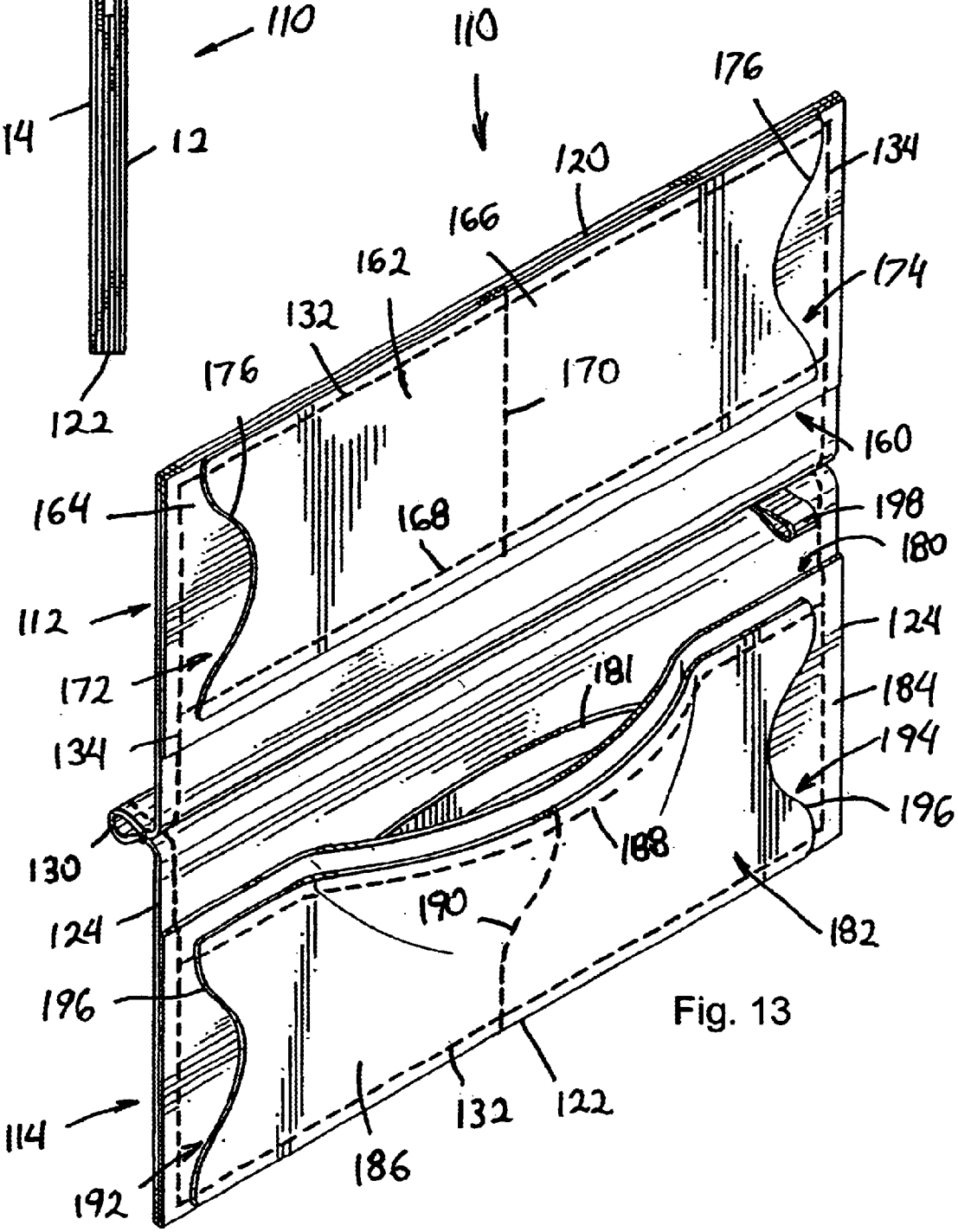
Fig. 13

Fig. 19
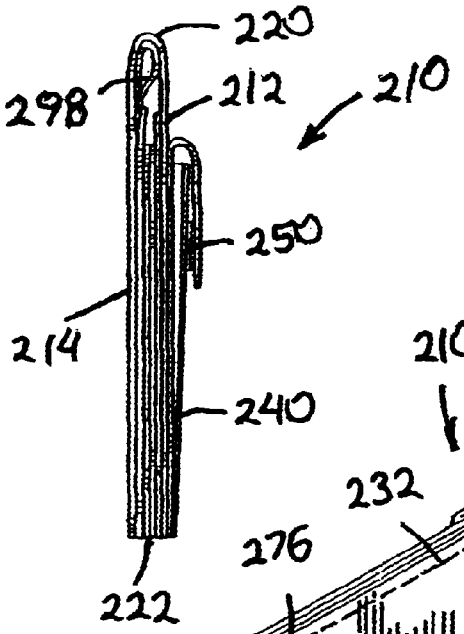
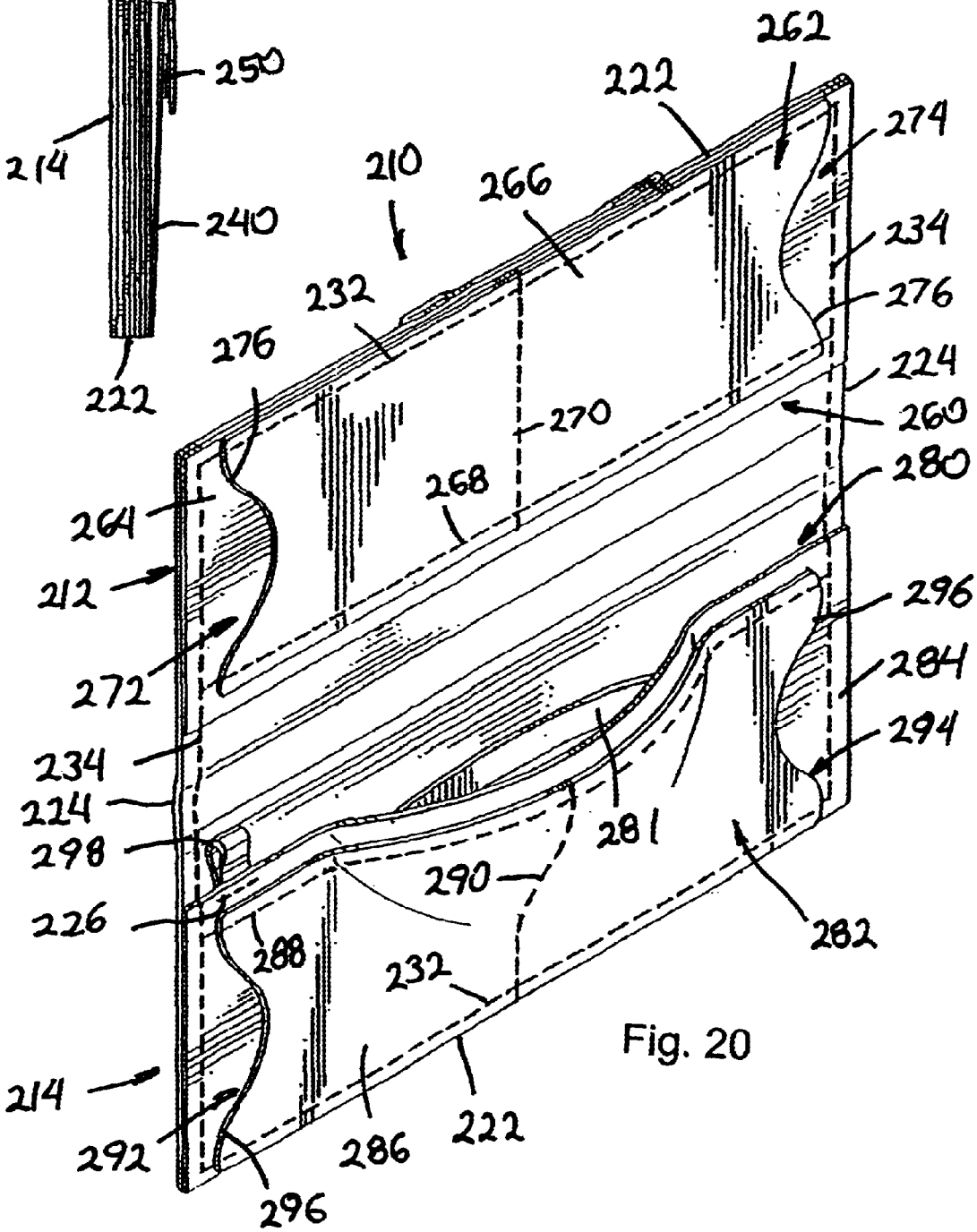
Fig. 20

Fig. 25
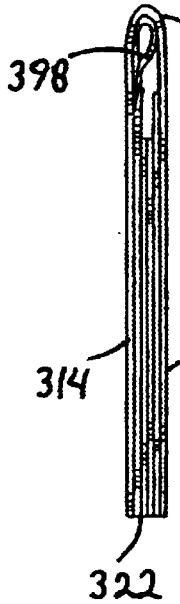
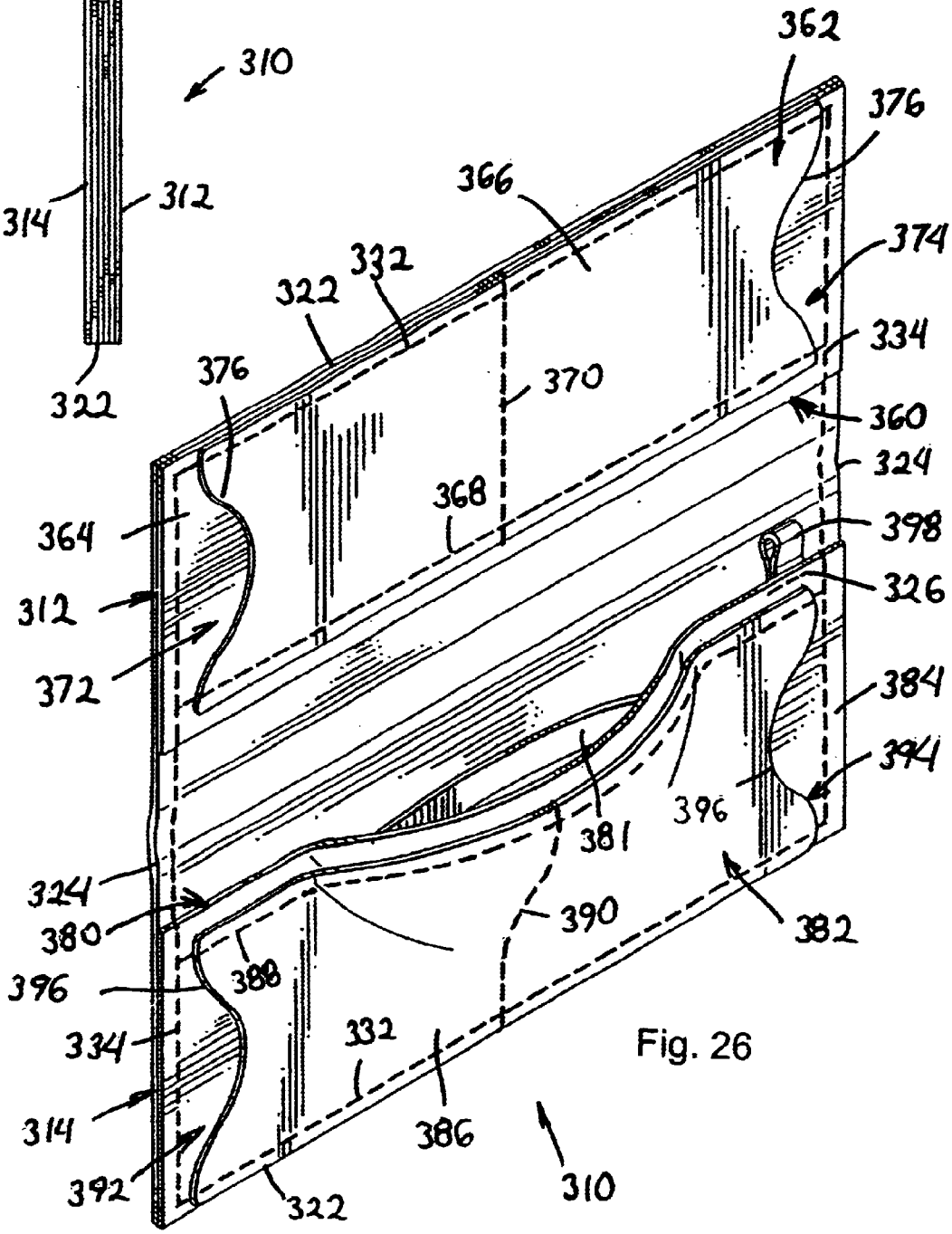
Fig. 26

BILLFOLD

REFERENCE TO RELATED APPLICATION

This application claims the benefit of U.S. provisional patent application Serial No. 60/218,633, filed Jul. 17, 2000, the disclosure of which is incorporated herein by this reference.

FIELD OF THE INVENTION

The present invention relates generally to devices for transporting personal belongings that may be worn in a pocket of a person's clothing. More particularly, the present invention relates to a billfold for holding currency bills, check books and credit cards.

BACKGROUND OF THE INVENTION

As the economy increases in complexity and the options available for payment increase, it becomes increasingly desirable to organize the devices, such as currency, checks and credit cards, associated with the payment options into a billfold or similar object that can be conveniently carried in a person's clothing. For example, people are often forced to carry numerous credit cards that are each used only for particular purposes such as business or personal purchases. Additionally, it is desirable for people to carry alternative payment devices because not all vendors accept a particular type of payment device. It is also desirable for the billfold to portray a desired style when the billfold is carried by a user.

SUMMARY OF THE INVENTION

The billfold of the present invention substantially meets the aforementioned needs of the industry. The billfold includes a front panel and a back panel that intersects the front panel along an edge. At least one of the front panel and the back panel have a first pocket formed therein. The first pocket has a width that permits currency to be placed therein in an unfolded orientation. The first pocket has a first retaining strap attached thereto that is sized to receive a portion of a checkbook to substantially prevent the checkbook from moving laterally in the first pocket.

BRIEF DESCRIPTION OF THE DRAWINGS

FIG. 6 is a side elevation view of the billfold illustrated in FIG. 1.

FIG. 7 is a perspective view of the billfold illustrated in FIG. 1 in an open position.

FIG. 12 is a side elevation view of the billfold illustrated in FIG. 8.

FIG. 13 is a perspective view of the billfold illustrated in FIG. 8 in an open position.

FIG. 19 is a side elevation view of the billfold illustrated in FIG. 14.

FIG. 20 is a perspective view of the billfold illustrated in FIG. 14 in an open position.

FIG. 25 is a side elevation view of the billfold illustrated in FIG. 21.

FIG. 26 is a perspective view of the billfold illustrated in FIG. 21 in an open position.

DETAILED DESCRIPTION OF PREFERRED EMBODIMENTS

Figure 1:
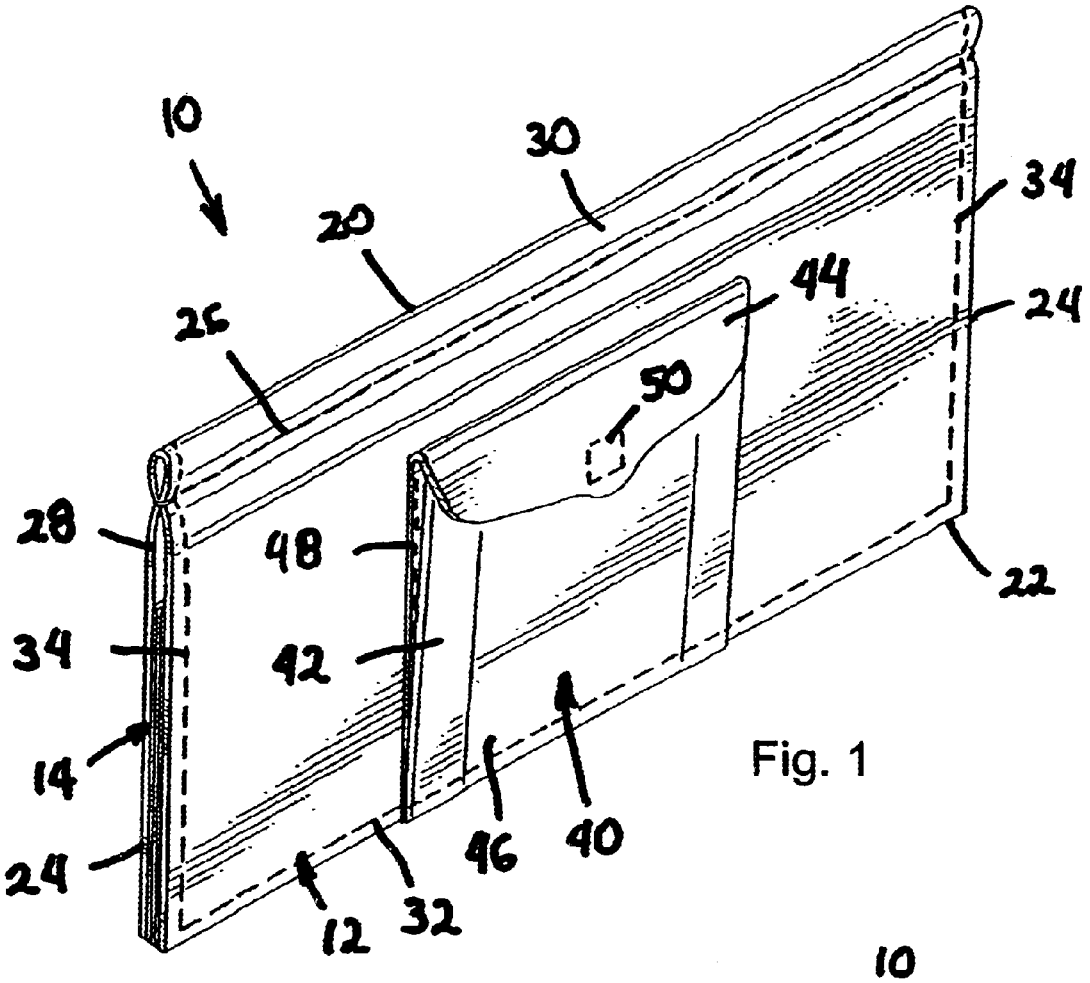
FIG. 1 is a perspective view of a billfold according to an embodiment of the present invention.
Figure 2:
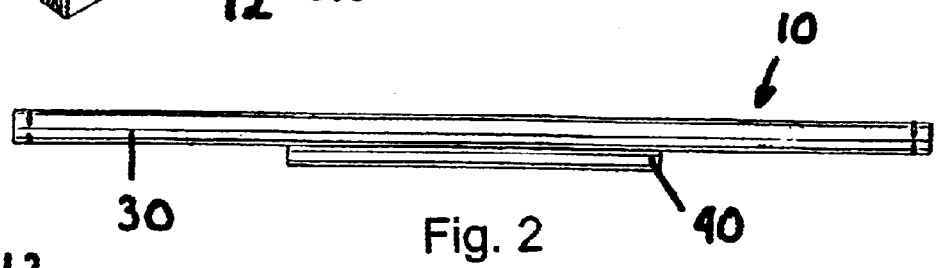
FIG. 2 is a top plan view of the billfold illustrated in FIG. 1.
Figure 3:
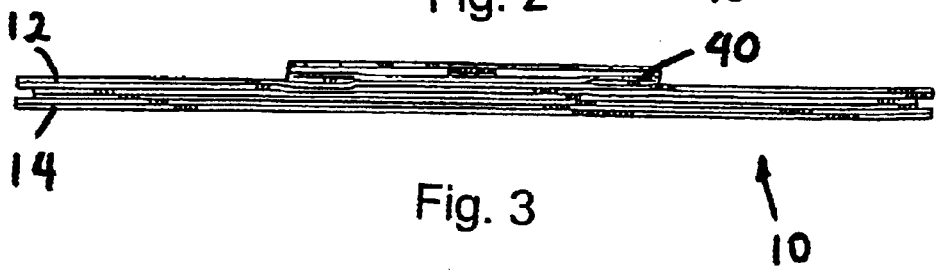
FIG. 3 is a bottom plan view of the billfold illustrated in FIG. 1.

A first embodiment of the billfold of the present invention is illustrated at 10 in FIGS. 1–5. The billfold 10 generally includes a front panel 12 and a back panel 14 that are pivotally mounted with respect to each other. The front panel 12 and the back panel 14 both have an upper edge 20, a lower edge 22, and a pair of side edges 24.

Figure 4:
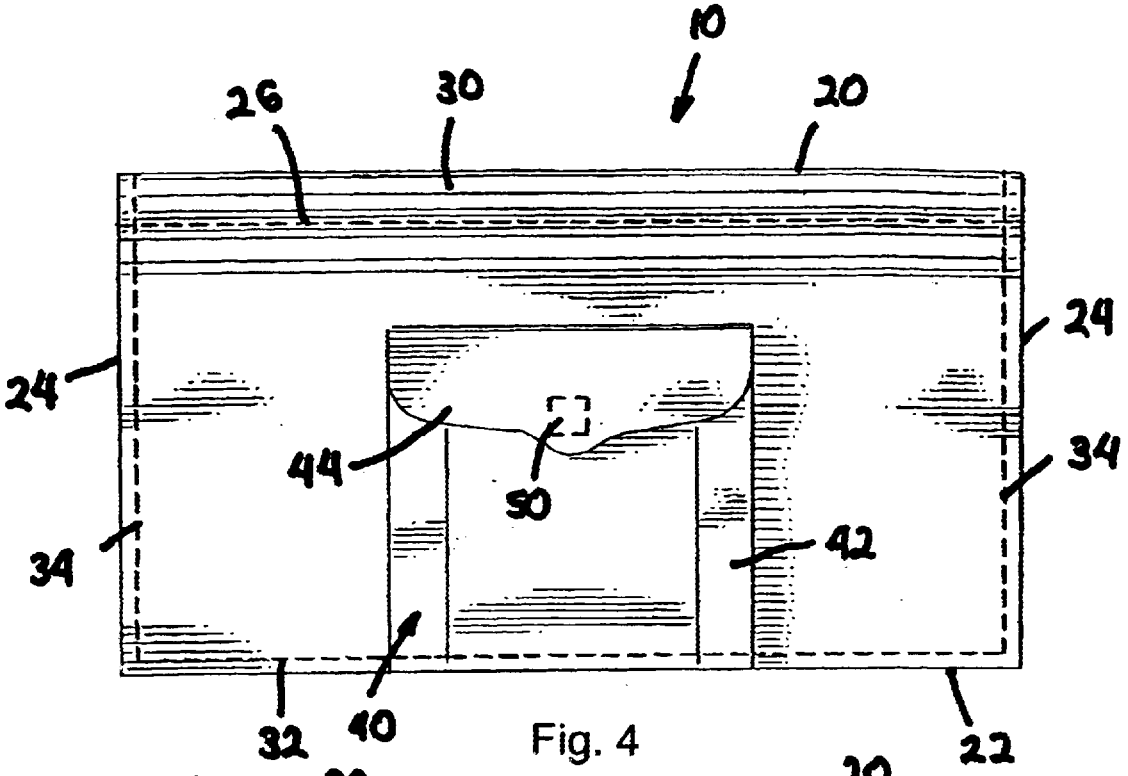
FIG. 4 is a front elevation view of the billfold illustrated in FIG. 1.
Figure 5:
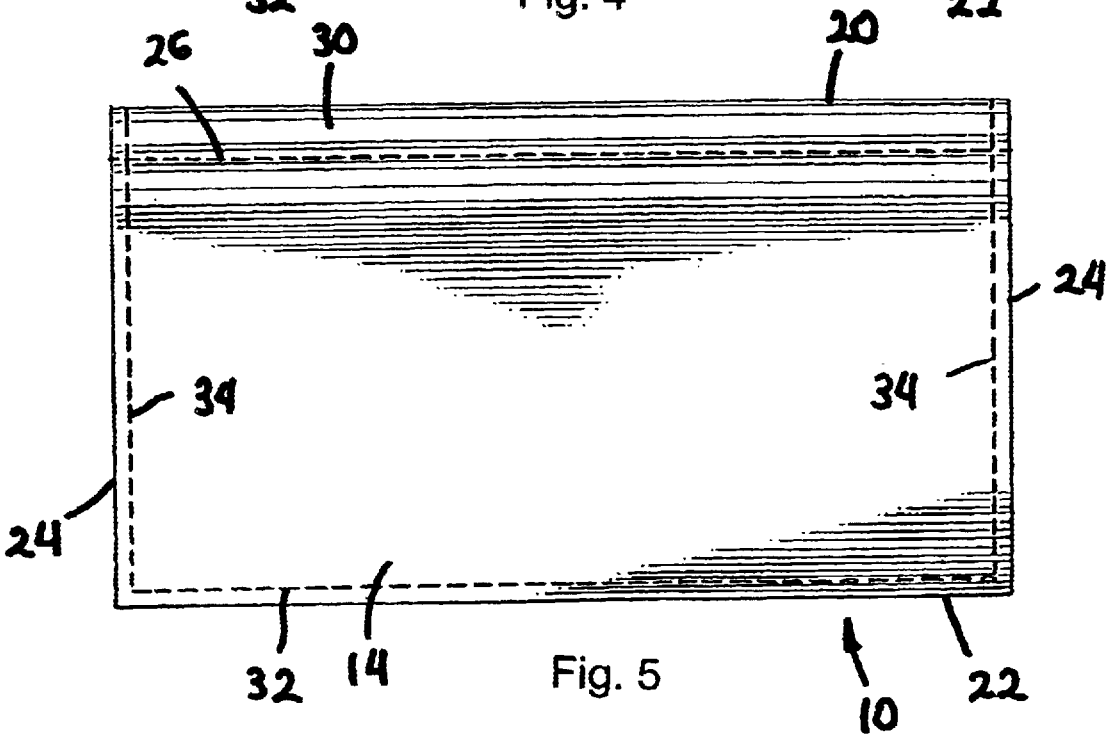
FIG. 5 is a rear elevation view of the billfold illustrated in FIG. 1.

Proximate the upper edge 20 where the front panel 12 and the back panel 14 intersect, the front panel 12 and the back panel 14 are joined together with an upper stitch line 26 that extends between the side edges 24, as most clearly illustrated in FIGS. 1, 4 and 5. The upper stitch line 26 defines a spine 30.

A neck portion 28 of the billfold 10 that is located proximate the stitch line 26 expands to maintain the front panel 12 and the back panel 14 in a substantially parallel orientation when the front panel 12 and the back panel 14 are in the closed orientation with checkbooks, check registers, currency and credit cards stored in the billfold 10.

The front panel 12 and the back panel 14 each have a lower stitch line 32 proximate the lower edge 22 that extends substantially between the side edges 24. The front panel 12 and the back panel 14 also each have a pair of side stitch lines 34 proximate the side edges 24 that extends substantially between the upper edge 20 and the lower edge 22.

The billfold 10 also preferably includes a coin pouch 40 attached to the front panel 12 intermediate the side edges 24. The coin pouch 40 generally includes a receiving portion 42 and a closure flap 44. The receiving portion 42 has a front panel 46 and a pair of side panels 48. A lower edge of the front panel 46 is attached to the front panel 12 proximate to the lower edge 22. The side panels 48 extend between the front panel 12 and the front panel 46 to thereby define a partially enclosed region.

The closure flap 44 is attached to the front panel 12 proximate an opening in the partially enclosed region. The closure flap 44 extends over the opening and thereby substantially encloses the opening to retain objects, such as coins, in the coin pouch 40. A detachable fastening device 50 retains the closure flap 44 in a closed position with respect to the receiving portion 42. The detachable fastening device is preferably a hook and latch closure such as marketed under the designation VELCRO.

The billfold 10 includes a first checkbook receiving portion 60 and an upper card receiving portion 62 attached to the front panel 12, as most clearly illustrated in FIG. 7. The first checkbook receiving portion 60 is preferably defined by a first panel 64 that extends substantially between the side edges 24. Preferably, the first panel 64 is attached to the front panel 12 with the lower stitch line 32 and the side stitch lines 34.

The first checkbook receiving portion 60 is adapted to receive a portion of a checkbook such as the checkbook register (not shown). Alternatively, the first checkbook receiving portion 60 may be used to store credit cards, currency or other items having a similar size and shape.

The upper card receiving portion 62 is preferably defined by a second panel 66 that substantially extends over the first panel 64. The second panel 66 is attached to the front panel 12 and the first panel 64 with the lower stitch line 32. The second panel 66 is attached to the first panel 64 opposite the lower stitch 32 with a stitch line 68. Intermediate the side edges 24, the second panel 66 is attached to the first panel 64 with a stitch line 70. The second panel 66 and the first panel 64 thereby define a first region 72 and a second region 74 that are each adapted to receive at least one identification card, credit card, business card or combination thereof.

To enhance the ability to insert and remove items from the first region 72 and the second region 74, the second panel 66 preferably includes an arcuate edge 76 opposite the stitch line 70.

The billfold 10 includes a second checkbook receiving portion 80 and a lower card receiving portion 82 attached to the back panel 14, as most clearly illustrated in FIG. 7. The second checkbook receiving portion 80 is preferably defined by a third panel 84 that extends substantially between the side edges 24. Preferably, the third panel 84 is attached to the back panel 14 with the lower stitch line 32 and the side stitch lines 34.

The first checkbook receiving portion 60 and the second checkbook receiving portion 80 have a width of between about 6 inches and 8 inches and preferably about 7 inches. The first checkbook receiving portion 60 and the second checkbook receiving portion 80 have a depth of between about 2 inches and 4 inches and preferably about 3 inches.

The second checkbook receiving portion 80 has a width that permits paper currency such as United States dollar bills to be placed therein in an unfolded configuration. The second checkbook receiving portion 80 thereby enhances the ability of a user to view the currency without removing the currency from the billfold.

The second checkbook receiving portion 80 is adapted to receive a portion of a checkbook such as the checkbook (not shown). Alternatively, the second checkbook receiving portion 80 may be used to store credit cards, currency or other items having a similar size and shape.

To enhance the ability to maintain the checkbook at a desired location within the second checkbook receiving portion 80, the billfold 10 preferably includes a retaining strap 81, as most clearly illustrated in FIG. 7. Opposite ends of the retaining strap 81 are attached to the third panel 84 opposite the fourth panel 86. Preventing the checkbook from sliding laterally is particularly desirable as the width of the checkbook receiving portion 80 is larger than the width of the checkbook. While not illustrated in the figures, the checkbook receiving portion 60 may also include a retaining strap that has a configuration similar to the retaining strap 81.

The lower card receiving portion 84 is preferably defined by a fourth panel 86 that substantially extends over the third panel 84. The fourth panel 86 is attached to the back panel 14 and the third panel 84 with the lower stitch line 32. The fourth panel 86 is attached to the third panel 84 opposite the lower stitch 32 with a stitch line 88. Intermediate the side edges 24, the fourth panel 86 is attached to the third panel 84 with a stitch line 90. The fourth panel 86 and the third panel 84 thereby define a first region 92 and a second region 94 that are each adapted to receive at least one identification card, credit card, business card or combination thereof.

To enhance the ability to insert and remove items from the first region 92 and the second region 94, the fourth panel 86 preferably includes an arcuate edge 96 opposite the stitch line 90.

Proximate the intersection of the front panel 12 and the back panel 14 and intermediate the side edges 24, the billfold 10 includes a loop 98. The loop 98 is preferably attached to the front panel 12 and the back panel 14 with the upper stitch line 26. The loop 98 is adapted to receive an elongated portion of a pen, pencil or similar device that is used for making entries in the checkbook stored in the billfold 10.

The billfold 10 is preferably fabricated from leather. However, a person of ordinary skill in the art will appreciate that the billfold 10 may be fabricated from alternative natural and synthetic materials using the concepts of the present invention.

A second embodiment of the billfold of the present invention is illustrated at 110 in FIGS. 8–13. The billfold 110 generally includes a front panel 112 and a back panel 114 that are pivotally mounted with respect to each other. The front panel 112 and the back panel 114 both have an upper edge 120, a lower edge 122, and a pair of side edges 124.

Figure 8:
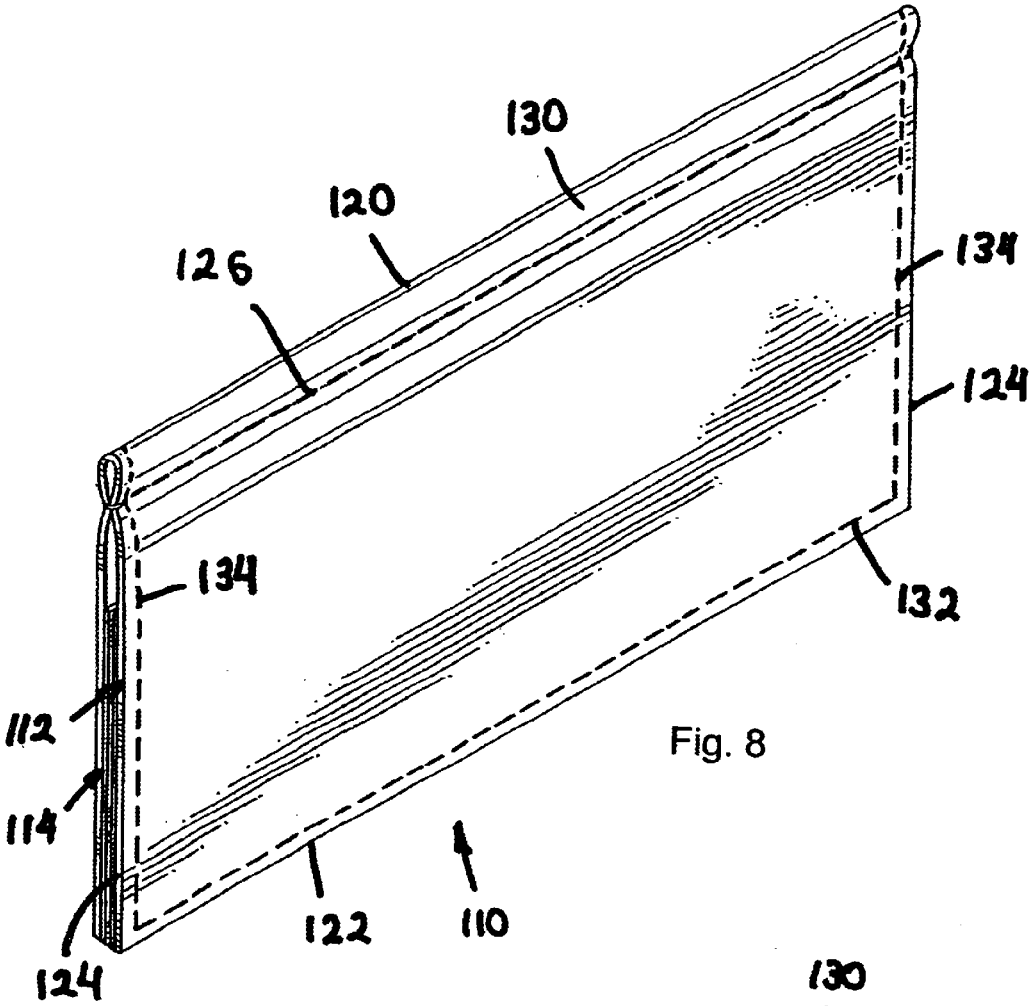
FIG. 8 is a perspective view of an alternative embodiment of the billfold.
Figure 9:
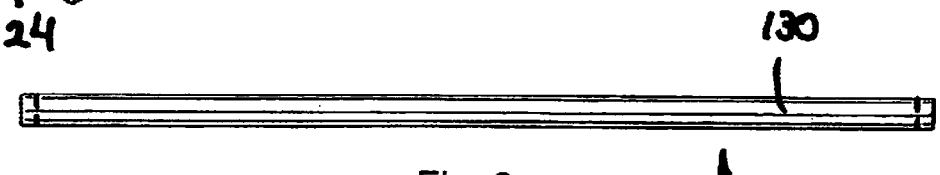
FIG. 9 is a top plan view of the billfold illustrated in FIG. 8.
Figure 10:
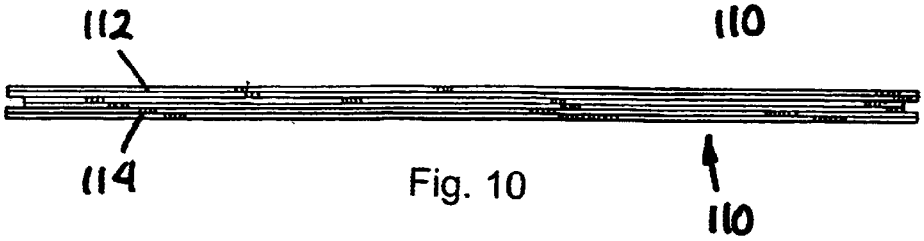
FIG. 10 is a bottom plan view of the billfold illustrated in FIG. 8.
Figure 11:
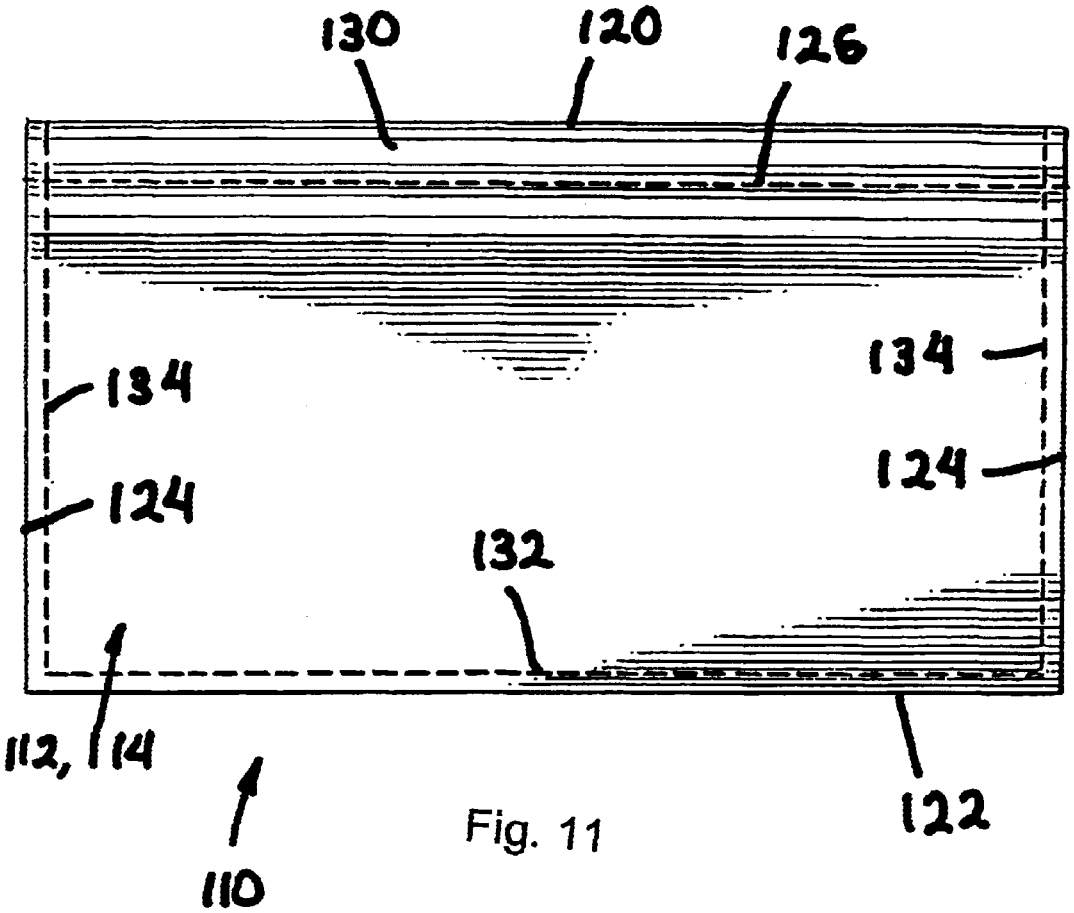
FIG. 11 is a front elevation view of the billfold illustrated in FIG. 8.
Figure 14:
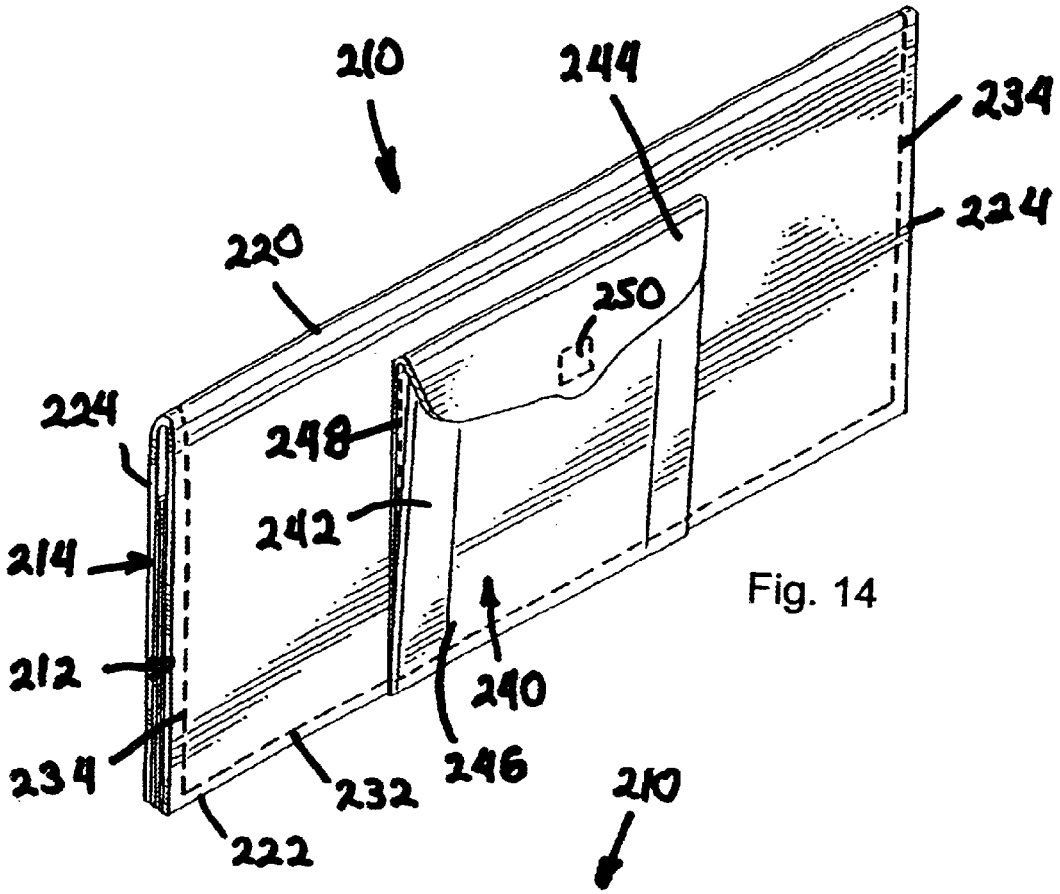
FIG. 14 is a perspective view of a billfold according to an embodiment of the present invention.
Figure 15:
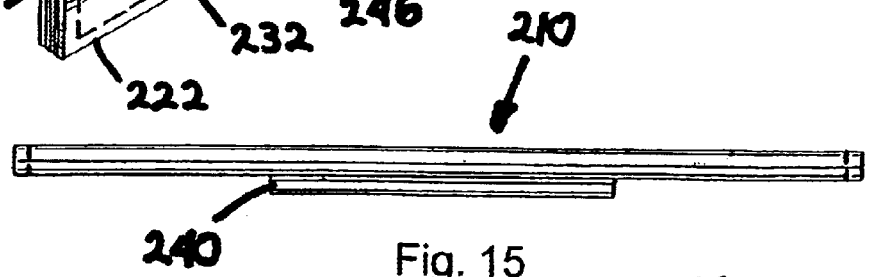
FIG. 15 is a top plan view of the billfold illustrated in FIG. 14.
Figure 16:
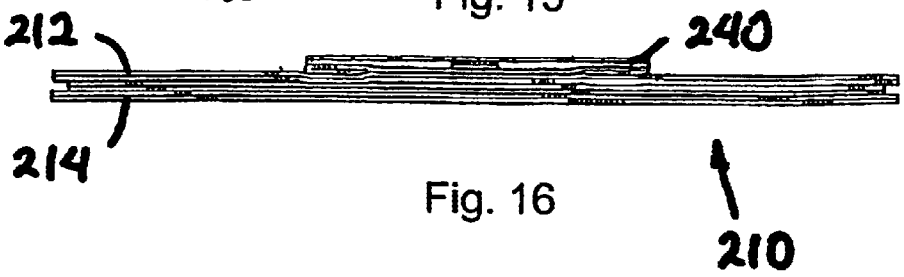
FIG. 16 is a bottom plan view of the billfold illustrated in FIG. 14.
Figure 17:
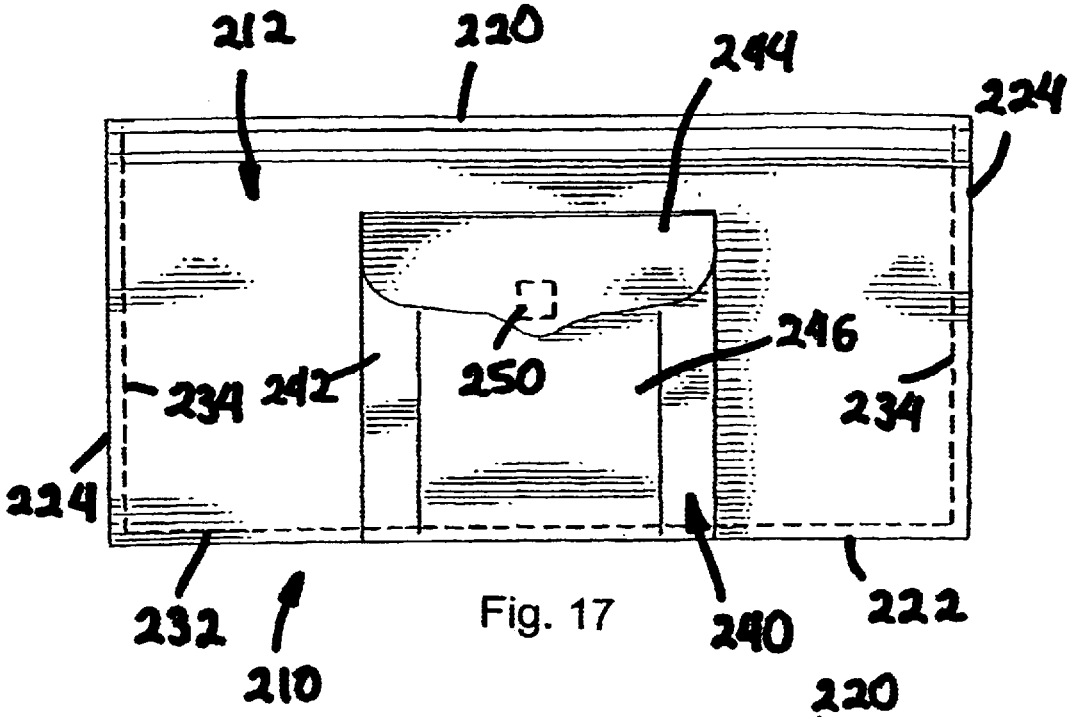
FIG. 17 is a front elevation view of the billfold illustrated in FIG. 14.
Figure 18:
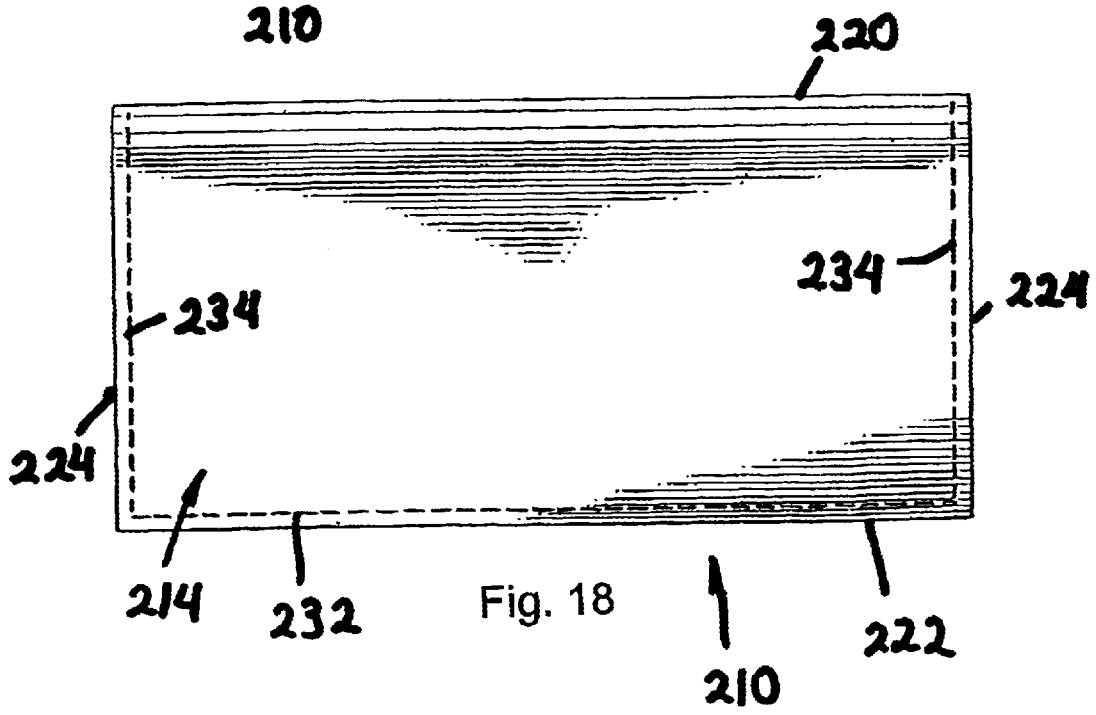
FIG. 18 is a rear elevation view of the billfold illustrated in FIG. 14.
Figure 21:
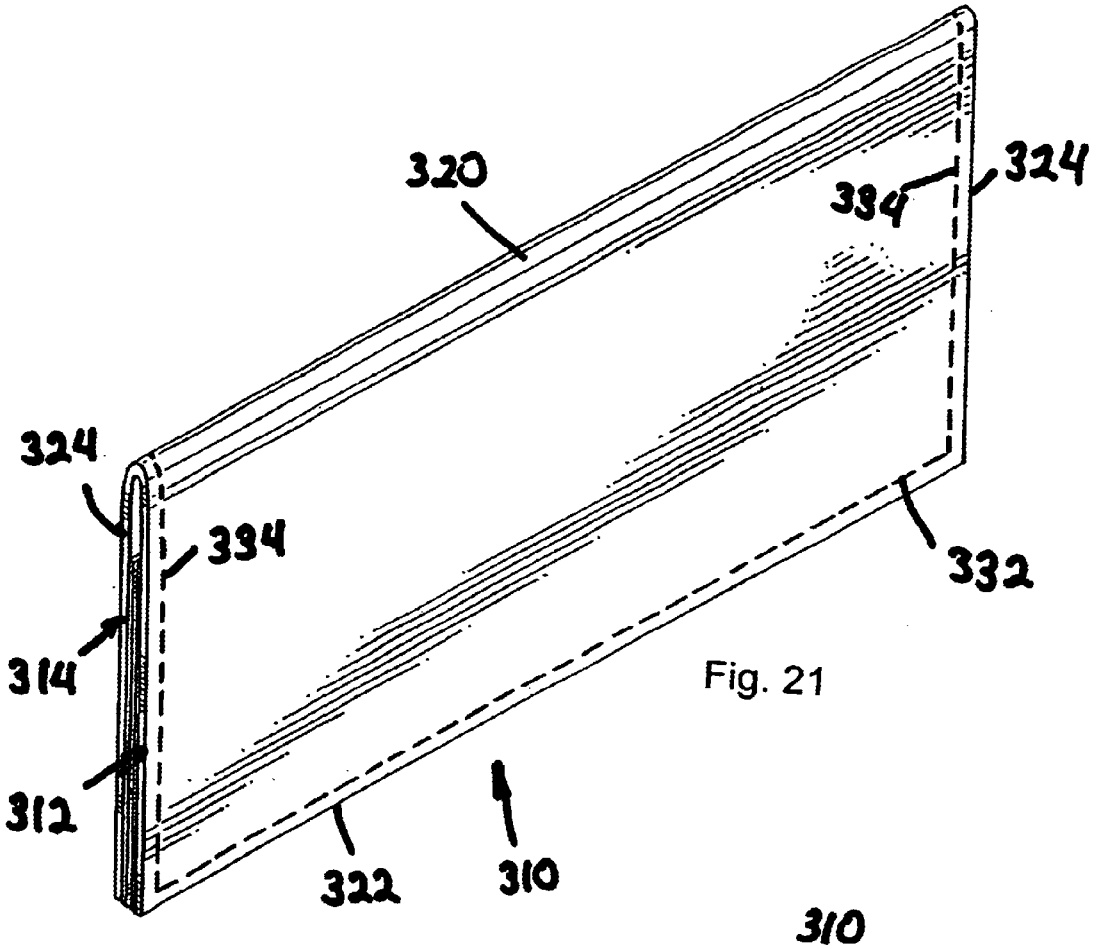
FIG. 21 is a perspective view of an alternative embodiment of the billfold.
Figure 22:
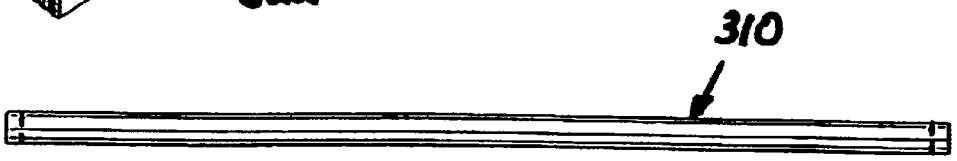
FIG. 22 is a top plan view of the billfold illustrated in FIG. 21.
Figure 23:
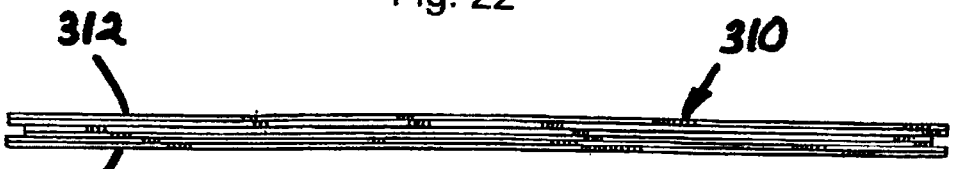
FIG. 23 is a bottom plan view of the billfold illustrated in FIG. 21.
Figure 24:
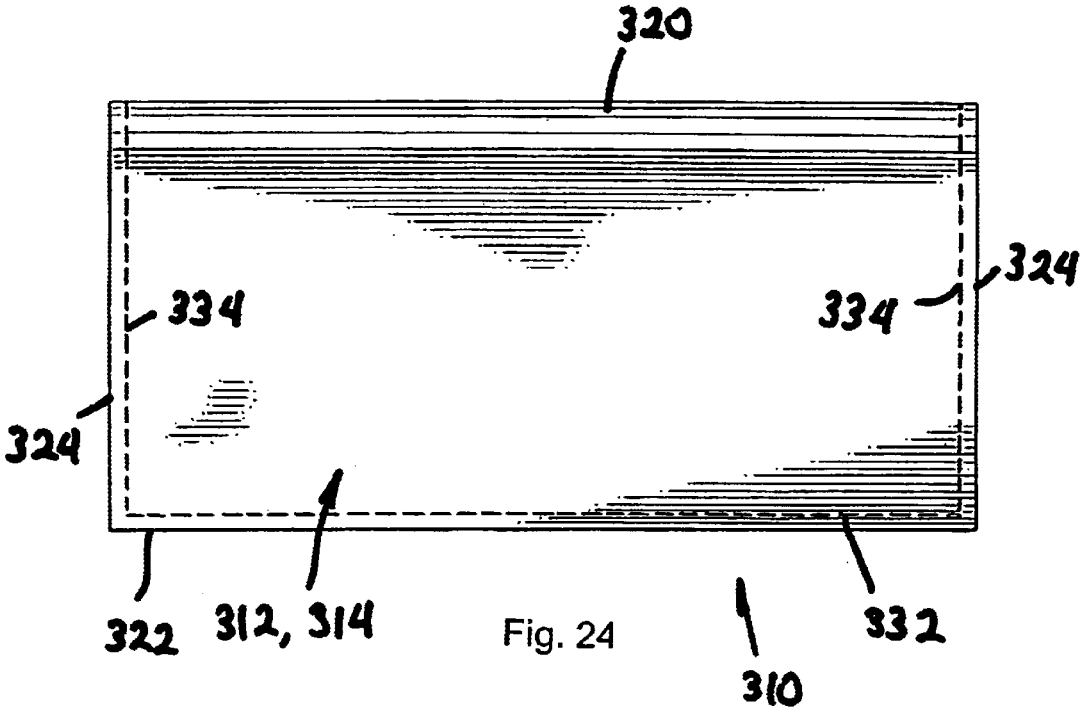
FIG. 24 is a front elevation view of the billfold illustrated in FIG. 21.

Proximate the upper edge 120 where the front panel 112 and the back panel 114 intersect, the front panel 112 and the back panel 114 are joined together with an upper stitch line 126 that extends between the side edges 124, as most clearly illustrated in FIGS. 8 and 11. The upper stitch line 126 defines a spine 130.

The front panel 112 and the back panel 114 each have a lower stitch line 132 proximate the lower edge 122 that extends substantially between the side edges 124. The front panel 112 and the back panel 114 also each have a pair of side stitch lines 134 proximate the side edges 124 that extends substantially between the upper edge 120 and the lower edge 122.

The billfold 110 includes a first checkbook receiving portion 160 and an upper card receiving portion 162 attached to the front panel 112, as most clearly illustrated in FIG. 13. The first checkbook receiving portion 160 is preferably defined by a first panel 164 that extends substantially between the side edges 124. Preferably, the first panel 164 is attached to the front panel 112 with the lower stitch line 132 and the side stitch lines 134.

The first checkbook receiving portion 160 is adapted to receive a portion of a checkbook such as the checkbook register (not shown). Alternatively, the first checkbook receiving portion 160 may be used to store credit cards, currency or other items having a similar size and shape.

The upper card receiving portion 162 is preferably defined by a second panel 166 that substantially extends over the first panel 164. The second panel 166 is attached to the front panel 112 and the first panel 164 with the lower stitch line 132. The second panel 166 is attached to the first panel 164 opposite the lower stitch 132 with a stitch line 168. Intermediate the side edges 124, the second panel 166 is attached to the first panel 164 with a stitch line 170. The second panel 166 and the first panel 164 thereby define a first region 172 and a second region 174 that are each adapted to receive at least one identification card, credit card, business card or combination thereof.

To enhance the ability to insert and remove items from the first region 172 and the second region 174, the second panel 166 preferably includes an arcuate edge 176 opposite the stitch line 170.

The billfold 110 includes a second checkbook receiving portion 180 and a lower card receiving portion 182 attached to the back panel 114, as most clearly illustrated in FIG. 13. The second checkbook receiving portion 180 is preferably defined by a third panel 184 that extends substantially between the side edges 124. Preferably, the third panel 184 is attached to the back panel 114 with the lower stitch line 132 and the side stitch lines 134.

The second checkbook receiving portion 180 is adapted to receive a portion of a checkbook such as the checkbook (not shown). Alternatively, the second checkbook receiving portion 180 may be used to store credit cards, currency or other items having a similar size and shape. The second checkbook receiving portion 180 has a width that permits currency to be placed therein in an unfolded orientation.

To enhance the ability to maintain the checkbook at a desired location within the second checkbook receiving portion 180, the billfold 110 preferably includes a retaining strap 181, as most clearly illustrated in FIG. 13. Opposite ends of the retaining strap 181 are attached to the third panel 184 opposite the fourth panel 186. The retaining strap 181 thereby maintains a checkbook at a desired location in the second checkbook receiving portion 180.

The lower card receiving portion 184 is preferably defined by a fourth panel 186 that substantially extends over the third panel 184. The fourth panel 186 is attached to the back panel 114 and the third panel 184 with the lower stitch line 132. The fourth panel 186 is attached to the third panel 184 opposite the lower stitch 132 with a stitch line 188. Intermediate the side edges 124, the fourth panel 186 is attached to the third panel 184 with a stitch line 190. The fourth panel 186 and the third panel 184 thereby define a first region 192 and a second region 194 that are each adapted to receive at least one identification card, credit card, business card or combination thereof.

To enhance the ability to insert and remove items from the first region 192 and the second region 194, the fourth panel 186 preferably includes an arcuate edge 196 opposite the stitch line 190.

Proximate the intersection of the front panel 112 and the back panel 114 and intermediate the side edges 124, the billfold 110 includes a loop 198. The loop 198 is preferably attached to the front panel 112 and the back panel 114 with the upper stitch line 126. The loop 198 is adapted to receive an elongated portion of a pen, pencil or similar device that is used for making entries in the checkbook stored in the billfold 110.

The billfold 110 is preferably fabricated from leather. However, a person of ordinary skill in the art will appreciate that the billfold 110 may be fabricated from alternative natural and synthetic materials using the concepts of the present invention.

A third embodiment of the billfold of the present invention is illustrated at 210 in FIGS. 14-19. The billfold 210 generally includes a front panel 212 and a back panel 214 that are pivotally mounted with respect to each other. The front panel 212 and the back panel 214 both have an upper edge 220, a lower edge 222, and a pair of side edges 224.

The front panel 212 and the back panel 214 each have a lower stitch line 232 proximate the lower edge 222 that extends substantially between the side edges 224. The front panel 212 and the back panel 214 also each have a pair of side stitch lines 234 proximate the side edges 224 that extends substantially between the upper edge 220 and the lower edge 222.

The billfold 210 also preferably includes a coin pouch 240 attached to the front panel 212 intermediate the side edges 224. The coin pouch 240 generally includes a receiving portion 242 and a closure flap 244. The receiving portion 242 has a front panel 246 and a pair of side panels 248. A lower edge of the front panel 246 is attached to the front panel 212 proximate to the lower edge 222. The side panels 248 extend between the front panel 212 and the front panel 246 to thereby define a partially enclosed region.

The closure flap 244 is attached to the front panel 212 proximate an opening in the partially enclosed region. The closure flap 244 extends over the opening and thereby substantially encloses the opening to retain objects, such as coins, in the coin pouch 240. A detachable fastening device 250 retains the closure flap 244 in a closed position with respect to the receiving portion 242. The detachable fastening device is preferably a hook and latch closure such as marketed under the designation VELCRO.

The billfold 210 includes a first checkbook receiving portion 260 and an upper card receiving portion 262 attached to the front panel 212, as most clearly illustrated in FIG. 20. The first checkbook receiving portion 260 is preferably defined by a first panel 264 that extends substantially between the side edges 224. Preferably, the first panel 264 is attached to the front panel 212 with the lower stitch line 232 and the side stitch lines 234.

The first checkbook receiving portion 260 is adapted to receive a portion of a checkbook such as the checkbook register (not shown). Alternatively, the first checkbook receiving portion 260 may be used to store credit cards, currency or other items having a similar size and shape.

The upper card receiving portion 262 is preferably defined by a second panel 266 that substantially extends over the first panel 264. The second panel 266 is attached to the front panel 212 and the first panel 264 with the lower stitch line 232. The second panel 266 is attached to the first panel 264 opposite the lower stitch 232 with a stitch line 268. Intermediate the side edges 224, the second panel 266 is attached to the first panel 264 with a stitch line 270. The second panel 266 and the first panel 264 thereby define a first region 272 and a second region 274 that are each adapted to receive at least one identification card, credit card, business card or combination thereof.

To enhance the ability to insert and remove items from the first region 272 and the second region 274, the second panel 266 preferably includes an arcuate edge 276 opposite the stitch line 270.

The billfold 210 includes a second checkbook receiving portion 280 and a lower card receiving portion 282 attached to the back panel 214, as most clearly illustrated in FIG. 20. The second checkbook receiving portion 280 is preferably defined by a third panel 284 that extends substantially between the side edges 224. Preferably, the third panel 284 is attached to the back panel 214 with the lower stitch line 232 and the side stitch lines 234.

The second checkbook receiving portion 280 is adapted to receive a portion of a checkbook such as the checkbook (not shown). Alternatively, the second checkbook receiving portion 280 may be used to store credit cards, currency or other items having a similar size and shape. The second checkbook receiving portion 280 has a width that permits currency to be placed therein in an unfolded orientation.

To enhance the ability to maintain the checkbook at a desired location within the second checkbook receiving portion 280, the billfold 210 preferably includes a retaining strap 281, as most clearly illustrated in FIG. 20. Opposite ends of the retaining strap 281 are attached to the third panel 284 opposite the fourth panel 286. The retaining strap 281 thereby maintains a checkbook at a desired location in the second checkbook receiving portion 280.

The lower card receiving portion 282 is preferably defined by a fourth panel 286 that substantially extends over the third panel 284. The fourth panel 286 is attached to the back panel 214 and the third panel 284 with the lower stitch line 232. The fourth panel 286 is attached to the third panel 284 opposite the lower stitch 232 with a stitch line 288. Intermediate the side edges 224, the fourth panel 286 is attached to the third panel 284 with a stitch line 290. The fourth panel 286 and the third panel 284 thereby define a first region 292 and a second region 294 that are each adapted to receive at least one identification card, credit card, business card or combination thereof.

Proximate the intersection of the front panel 212 and the back panel 214 and intermediate the side edges 224, the billfold 210 includes a loop 298. The loop 298 is preferably attached to the back panel 214 with an upper stitch line 226. The loop 298 is adapted to receive an elongated portion of a pen, pencil or similar device that is used for making entries in the checkbook stored in the billfold 210.

The billfold 210 is preferably fabricated from leather. However, a person of ordinary skill in the art will appreciate that the billfold 210 may be fabricated from alternative natural and synthetic materials using the concepts of the present invention.

A fourth embodiment of the billfold of the present invention is illustrated at 310 in FIGS. 21–25. The billfold 10 generally includes a front panel 312 and a back panel 314 that are pivotally mounted with respect to each other. The front panel 312 and the back panel 314 both have an upper edge 320, a lower edge 322, and a pair of side edges 324.

The front panel 312 and the back panel 314 each have a lower stitch line 332 proximate the lower edge 322 that extends substantially between the side edges 324. The front panel 312 and the back panel 314 also each have a pair of side stitch lines 334 proximate the side edges 324 that extends substantially between the upper edge 320 and the lower edge 322.

The billfold 310 includes a first checkbook receiving portion 360 and an upper card receiving portion 362 attached to the front panel 312, as most clearly illustrated in FIG. 26. The first checkbook receiving portion 360 is preferably defined by a first panel 364 that extends substantially between the side edges 324. Preferably, the first panel 364 is attached to the front panel 312 with the lower stitch line 332 and the side stitch lines 334.

The first checkbook receiving portion 360 is adapted to receive a portion of a checkbook such as the checkbook register (not shown). Alternatively, the first checkbook receiving portion 360 may be used to store credit cards, currency or other items having a similar size and shape.

The upper card receiving portion 362 is preferably defined by a second panel 366 that substantially extends over the first panel 364. The second panel 366 is attached to the front panel 312 and the first panel 364 with the lower stitch line 332. The second panel 366 is attached to the first panel 364 opposite the lower stitch 332 with a stitch line 368. Intermediate the side edges 324, the second panel 366 is attached to the first panel 364 with a stitch line 370. The second panel 366 and the first panel 364 thereby define a first region 372 and a second region 374 that are each adapted to receive at least one identification card, credit card, business card or combination thereof.

To enhance the ability to insert and remove items from the first region 372 and the second region 374, the second panel 366 preferably includes an arcuate edge 376 opposite the stitch line 370.

The billfold 310 includes a second checkbook receiving portion 380 and a lower card receiving portion 382 attached to the back panel 314, as most clearly illustrated in FIG. 26. The second checkbook receiving portion 380 is preferably defined by a third panel 384 that extends substantially between the side edges 324. Preferably, the third panel 384 is attached to the back panel 314 with the lower stitch line 332 and the side stitch lines 334.

The second checkbook receiving portion 380 is adapted to receive a portion of a checkbook such as the checkbook (not shown). Alternatively, the second checkbook receiving portion 380 may be used to store credit cards, currency or other items having a similar size and shape. The second checkbook receiving portion 380 has a width that permits currency to be placed therein in an unfolded orientation.

To enhance the ability to maintain the checkbook at a desired location within the second checkbook receiving portion 380, the billfold 310 preferably includes a retaining strap 381, as most clearly illustrated in FIG. 26. Opposite ends of the retaining strap 381 are attached to the third panel 384 opposite the fourth panel 386. The retaining strap 381 thereby maintains a checkbook at a desired location in the second checkbook receiving portion 380.

The lower card receiving portion 384 is preferably defined by a fourth panel 386 that substantially extends over the third panel 384. The fourth panel 386 is attached to the back panel 314 and the third panel 384 with the lower stitch line 332. The fourth panel 386 is attached to the third panel 384 opposite the lower stitch 332 with a stitch line 388. Intermediate the side edges 324, the fourth panel 386 is attached to the third panel 384 with a stitch line 390. The fourth panel 386 and the third panel 384 thereby define a first region 392 and a second region 394 that are each adapted to receive at least one identification card, credit card, business card or combination thereof.

Proximate the intersection of the front panel 312 and the back panel 314 and intermediate the side edges 324, the billfold 310 includes a loop 398. The loop 398 is preferably attached to the back panel 314 with an upper stitch line 326. The loop 398 is adapted to receive an elongated portion of a pen, pencil or similar device that is used for making entries in the checkbook stored in the billfold 310.

The billfold 310 is preferably fabricated from leather. However, a person of ordinary skill in the art will appreciate that the billfold 310 may be fabricated from alternative natural and synthetic materials using the concepts of the present invention.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A billfold comprising:

a front panel; and a back panel that intersects the front panel along an edge, wherein at least one of the front panel and the back panel have a first pocket formed therein, wherein the first pocket has a width that permits currency to be placed therein in an unfolded orientation, and wherein the first pocket has a first retaining strap attached thereto that is sized to receive a portion of a checkbook to substantially prevent the checkbook from moving laterally in the first pocket while permitting checks to be filled in and detached from the checkbook without removing the checkbook from the billfold.

2. The billfold of claim 1, wherein the front panel and the back panel that does not have the first pocket attached thereto has a second pocket attached thereto, and wherein the second pocket has a second retaining strap attached thereto that is sized to receive a portion of a check register to substantially prevent the check register from moving laterally in the second pocket.

3. The billfold of claim 1, and further comprising a first card receiving portion attached to at least one of the front panel and the back panel.

4. The billfold of claim 3, and further comprising a second card receiving portion attached to front panel or the back panel to which the first card receiving portion is not attached.

5. The billfold of claim 3, wherein the first card receiving portion includes two adjacent card receiving regions that are each adapted to receive at least one credit card, identification card, business card, or combination thereof.

6. The billfold of claim 5, wherein the card receiving regions permit insertion of items into and removal therefrom from side edges of the front panel or back panel to which the card receiving portion is attached.

7. The billfold of claim 1, wherein the currency and the checkbook are retained in the billfold when the front panel and the back panel are in a closed configuration.

8. The billfold of claim 7, wherein a neck portion of the front panel and the back panel expands to maintain the front panel and the back panel in a substantially parallel orientation when the front panel and the back panel are in the closed configuration.

9. The billfold of claim 1, and further comprising a coin pouch attached to at least one of the front panel or the back panel.

10. The billfold of claim 9, and further comprising a closure flap that substantially closes the coin pouch.

11. The billfold of claim 1, wherein the pocket has a width of between about 6 inches and 8 inches.

12. The billfold of claim 1, wherein the pocket has a width of about 7 inches.

13. The billfold of claim 1, wherein the pocket has a depth of between about 2 inches and 4 inches.

14. The billfold of claim 1, wherein the pocket has a depth of about 3 inches.

15. The billfold of claim 1, wherein the first strap has a length that is approximately equal to a length of the checkbook.

16. A method of storing items in a billfold, the method comprising:

pivotally attaching a front panel to a back panel;

attaching a first pocket to at least one of the front panel and the back panel, wherein the pocket has a width that permits currency to be placed therein in an unfolded orientation; and attaching a first retaining strap to the first pocket, wherein the first retaining strap is sized to receive a portion of a checkbook and substantially prevent the checkbook from moving laterally in the first pocket while permitting checks to be filled in and detached from the checkbook without removing the checkbook from the billfold.

17. The method of claim 16, and further comprising attaching a first card receiving portion to at least one of the front panel and the back panel; and inserting at least one credit card, identification card, or business card into the first card receiving portion from a side surface of the front panel or back panel to which the first card receiving portion is attached.

18. The method of claim 16, and further comprising expanding a neck portion of the billfold as the front panel and the back panel are moved to a closed configuration to maintain the front panel and the back panel in a substantially parallel orientation.

19. The method of claim 16, and further comprising attaching a coin pouch to at least one of the front panel and the back panel.

20. The method of claim 19, and further comprising substantially closing the coin pouch with a closure flap.

* * * * *